United States Patent [19]

Boggs et al.

[11] 4,130,061

[45] Dec. 19, 1978

[54] GUN FIRED PROJECTILE HAVING REDUCED DRAG

[75] Inventors: Brian F. Boggs, West Simsbury, Conn.; Hector J. Zilcosky, Christiana, Pa.; William M. Smith, Simsbury, Conn.

[73] Assignee: Ensign Bickford Company, Simsbury, Conn.

[21] Appl. No.: 628,970

[22] Filed: Nov. 5, 1975

[51] Int. Cl.[2] ..... F42B 13/14; F42B 13/34

[52] U.S. Cl. ..... 102/66; 102/60; 102/87; 149/19.91

[58] Field of Search ..... 102/92.1, 6, 66, 90, 102/60, 87, 49.3; 149/19.91; 60/270 S, 251, 261

[56] References Cited

U.S. PATENT DOCUMENTS

| | | | |
|---|---|---|---|
| 2,319,248 | 5/1943 | Meek | 102/87 |
| 2,381,474 | 8/1945 | Turnbull | 102/87 |
| 3,494,285 | 2/1970 | Doris Jr. et al. | 102/87 |
| 3,507,221 | 4/1970 | Grolly | 102/87 X |
| 3,535,881 | 10/1970 | Schubert | 60/270 S |
| 3,677,181 | 7/1972 | Giljarhus et al. | 102/60 X |
| 3,761,329 | 9/1973 | Zilcosky | 149/19.91 |
| 3,886,009 | 5/1975 | Puchalski | 102/49.3 |
| 4,003,313 | 1/1977 | Puchalski | 102/60 |

OTHER PUBLICATIONS

"Wind-Tunnel Study of Projectile Base Drag Reduction Through Combustion of Solid Fuel-Rich, Propellants" by Baltakis and Ward.

*Primary Examiner*—Harold J. Tudor

[57] ABSTRACT

A fumer exhibiting reduced base drag and a high specific impulse is provided by using as the pyrotechnic charge in the projectile a composition comprising a metal powder/alkaline earth metal compound formulation containing at least about 20 percent by weight of a plasticized resin and at least about 10 percent by weight of an active oxidizer for said resin. The metal powder is present in greater than stoichiometric amounts relative to the amount of alkaline earth metal compound and the pyrotechnic composition is effective to provide rapid burning in the near wake area of the projectile and fuel-rich combustion products.

16 Claims, 1 Drawing Figure

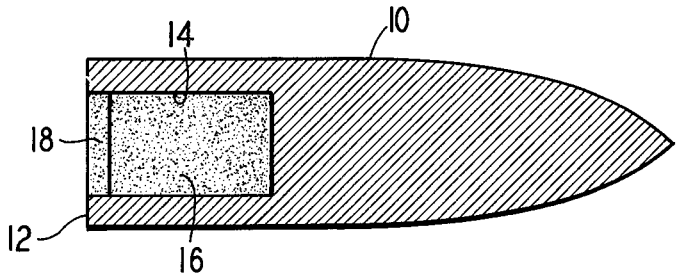
14
10
18
12
16

GUN FIRED PROJECTILE HAVING REDUCED DRAG

BACKGROUND AND SUMMARY OF THE INVENTION

The present invention relates generally to gun fired projectiles and is more particularly concerned with a new and improved gun fired projectile having reduced base drag.

It has been known for a long time that a gun fired projectile, such as a bullet, shell, etc., has a tendency during flight of forming a partial vacuum condition adjacent the flat, rear or base of the projectile. The partial vacuum or low pressure condition at the base of the projectile provides, in effect, a force component acting against the direction of motion of the projectile. This force component is commonly referred to as "base drag." In fact, at the transonic or low supersonic speeds of conventional gun fired projectiles, for example, at speeds of about Mach 2, the base drag may constitute more than 50 percent of the total drag acting on the projectile and reducing its flight velocity.

Various pyrotechnic materials have been loaded into base cavities in the projectiles and ignited at the time of discharge so that the burning of the pyrotechnic at least partially fills the vacuum generated by the projectile, thus reducing the base drag and aiding the flight of the projectile. The projectiles containing such pyrotechnic compositions are commonly referred to as "fumers." Some presently available fumers use dry pyrotechnic powder components that must be formed into a consolidated state by mixing with binding agents to hold the pyrotechnic charge in the projectile cavity during flight. However, such mixes are frequently poor performers relative to base drag reduction primarily due to the presence of the binding agents. Other fumers of the castable type also are undesirable because of their poor retention strength and inconsistent burning rate and performance.

Recently it was suggested in Puchalski, U.S. Pat. No. 3,886,009, that the pyrotechnic mixture used to reduce base drag should burn at high yield temperatures of at least 2700° C. and preferably 3500° C. in order to insure the production of sufficient pressure within the base area during flight. Pyrotechnic mixtures of the high temperature type mentioned in that patent required stoichiometric proportions of fuel and oxidizer and contained about 30 percent magnesium powder, 50 percent strontium nitrate, 8 percent calcium resinate and 10 percent gelatin. The patent stated that use of color intensifiers, such as polyvinyl chloride, in the pyrotechnic composition produced a deleterious effect on the base drag characteristics of the projectile.

In accordance with the present invention it has been found that reduced projectile base drag can be achieved without the high yield temperatures mentioned hereinbefore by utilizing a pyrotechnic that exhibits the characteristics of rapid burning in the near wake area of the projectile, i.e. immediately adjacent the flat base, and the production of fuel-rich combustion products that permit secondary reactions with the atmosphere in the near wake thereby improving specific impulse of the fumer. Accordingly, it is an object of the present invention to provide a fumer loaded with a pyrotechnic composition having these characteristics.

Another object of the present invention is to provide a new and improved fumer of the type described that exhibits high performance and a consistent burning rate over a prolonged period thereby improving the total impulse of the fumer and providing sustained base drag reduction.

Still another object of the present invention is to provide a new and improved fumer of the type described that utilizes a pyrotechnic composition of high adaptability since it is castable, moldable and pressable yet does not exhibit the low performance characteristics previously associated with such materials. Included in this object is the provision for a versatile composition that is easily adapted to existing projectile configurations while at the same time allows latitude in the design of new projectiles.

Yet another object of the present invention is to provide a new and improved fumer of the type described that utilizes a pyrotechnic composition having greater than stoichiometric amounts of fuel in the fuel-oxidizer mix and provides fuel-rich combustion products. Included in this object is a provision for a pyrotechnic fumer that also includes about 20 percent by weight and more of a plasticized resin color intensifier in conjunction with an active oxidizer, such as ammonium perchlorate and the like, for the resin.

Other objects will be in part obvious and in part pointed out more in detail hereinafter.

These and related objects are accomplished in accordance with the present invention by providing a fumer comprising a projectile having a base cavity and a pyrotechnic charge positioned within that cavity. The pyrotechnic charge is of the metal powder/alkaline earth metal compound type and contains about 20 percent by weight and more of a plasticized resin and about 10 percent by weight and more of an active oxidizer of the perchlorate type. The metal powder is present in greater than stoichiometric amounts relative to the alkaline earth metal compound and the charge provides rapid burning in the near wake area and fuel-rich combustion products.

A better understanding of the objects, advantages, features, properties and relationships of the invention will be obtained from the following detailed description which sets forth an illustrative embodiment and is indicative of the way in which the principles of the present invention are employed.

BRIEF DESCRIPTION OF THE DRAWING

The sole FIGURE is a sectional view of a fumer construction utilizable in accordance with the present invention.

DESCRIPTION OF A PREFERRED EMBODIMENT

The fumer of the present invention is shown as consisting essentially of a gun fired projectile 10 such as a conventional bullet, that is provided with a substantially flat base end portion 12 and a cavity 14 extending axially from the base 12 along a minor length portion of the projectile. The cavity is loaded with a suitable pyrotechnic charge 16. The specific configuration of the projectile 10 and of the cavity 14 may vary substantially, the configuration shown being for illustrative purposes only. Additionally, the pyrotechnic charge 16 may provide conventional end burning or may exhibit radial burning. If desired, a first fire mix 18 may be included, as shown, at the base of the charge 16 and in operative relationship therewith for igniting the charge 16 but the use of this mix 16 is optional. When used, it is typically of the metal/metal oxide type such as boron/red lead or other suitable first fire composition.

The pyrotechnic charge used in accordance with the present invention is substantially identical to the flare composition described in Zilcosky, U.S. Pat. No. 3,761,329, assigned to the assignee of this application. That composition is fully and completely described in the aforementioned patent and the disclosure therein is incorporated herein by reference. In accordance with the present invention it has been surprisingly found, contrary to the teaching of the above-mentioned Puchalski patent, that a pyrotechnic composition having a higher than stoichiometric fuel to oxidizer ratio and a yield temperature well below the minimum designated temperature of 2700° C., would provide not only reduced base drag but also improved specific impulse when used in a gun fired projectile.

As will be appreciated, the base pressure can vary substantially in flight and therefore it is important to consider not only pressure difference but also the burning time of the composition since reduced drag over a prolonged period of time will improve the over-all velocity of the projectile and provide improvement in the accuracy and striking energy of the projectile. Accordingly, the specific impulse of the projectile has been used as a measure of performance effectiveness. The specific impulse is obtained by integrating the base pressure increase with respect to time and base area and then dividing the result by the mass of pyrotechnic utilized. Thus a base drag reduction level of about 30 to 40 percent may indicate substantial superiority when coupled with a high specific impulse value, such as a value well above 500 seconds, as compared to greater base drag reduction levels for a projectile exhibiting a lower specific impulse value.

As will be appreciated, the pyrotechnic within a gun fired projectile must rapidly ignite in the gun and must sustain combustion when in flight at atmospheric conditions. According to the present invention the pyrotechnic propellent charge not only accomplished those requirements but also provides secondary reactions in the near wake with the atmosphere during flight. This charge consists of a powdered metal fuel, such as magnesium, aluminum, zirconium and the like, an alkaline earth metal salt, preferably a nitrate, such as strontium or barium nitrate, a plasticized organic resin, such as plasticized polyvinyl chloride, and a strong inorganic oxidizer for the foregoing, such as an inorganic perchlorate.

Thus it has been found that the pyrotechnic composition utilized in the fumer of the present invention generally falls within the range set forth in Table I.

TABLE I

| Components | Parts by weight | |
|---|---|---|
| | Range | Preferred |
| Metal powder | 20–35 | 25 |
| Alkaline earth metal compound | 30–55 | 35 |
| Resin | 10–30 | 10 |
| Plasticizer | 10–20 | 10 |
| Oxidizer | 10–30 | 20 |

As will be noted, the amount of fuels (metal powder, resin and plasticizer) in the preferred composition is greater stoichiometrically than the oxidizers (alkaline earth metal compound and oxidizer). In fact, the oxygen balance of the preferred composition is approximately 50 percent negative with the ratio of metal to salt being in excess of 2:3. This excess fuel composition has the dual function of not only providing an appropriate initial reaction but also providing a hot ready-state where excess fuel will secondarily react with oxygen in the atmosphere to rapidly fill in the void immediately adjacent the base of the projectile, referred to herein as the "near wake."

While the particular reactions leading to the high performance of the fumers of the present invention have not been fully explored, it is believed that this near wake, fuel-rich secondary reaction of the combustible products, and particularly the provision of the excess magnesium and its hot ready-state reaction with air in the projectile wake is primarily responsible for the improved specific impulse of the fumers of the present invention.

The preferred plasticized organic resins used in the pyrotechnic composition are the halogenated resins of high molecular weight polymers and copolymers having moderate to high halogen content, such as vinyl chloride and copolymers thereof. The preferred material, polyvinyl chloride, has an average molecular weight of about 200,000 and a chlorine content of about 56 percent. The resin is, of course, in the form of a plastisol, that is, a suspension of the resin in a suitable plasticizer in the absence of a volatile solvent. The resin suspension or dispersion contains no volatile components and preferably acts as a vehicle homogeneously admixing the remaining components of the entire formulation while at the same time serving as a binder therefor. The plasticizer is preferably of the general purpose type such as dioctyl phthalate and is used in substantially equal proportions with the resin to produce the desired plastisol.

The invention will be further described with reference to the following specific example which is provided so that the present invention can be more readily understood. As will be appreciated, the example is by way of illustration only and is not intended to be a limit on the practice of the invention.

EXAMPLE I

A pyrotechnic charge was prepared by initially mixing equal amounts of polyvinyl chloride resin having a molecular weight of 200,000 and a chlorine content of 56 percent and dioctyl phthalate plasticizer until the mix was homogeneous. To about 20 parts by weight of the resultant plastisol was added approximately 35 parts by weight of strontium nitrate and 25 parts by weight of magnesium powder. After thorough blending of the mixture about 20 parts by weight of ammonium perchlorate was added to the composition, and the entire mixture was blended for about 15 minutes. The resultant paste-like mixture was then heated in an oven at 340° F. for one half hour to produce a solid cohesive and flexible mass which was then ground in particles and used as the pyrotechnic composition in the fumers.

A charge of the above-described particulate composition was pressed and loaded into a projectile, a first fire mix such as boron-red lead was applied over the base end of the charge and the fumer was tested by the Naval Surface Weapons Laboratory at low supersonic speeds (Mach 1.5–2.5) using a reflected laser light beam for ignition. The fumer was found to exhibit a specific impulse value of 700 seconds at a base drag reduction level of about 40 percent under closely simulated projectile flight conditions.

A comparison of above formulation labelled Example I with two high temperature compositions is set forth in Table II below.

TABLE II

| | Pyrotechnic Compositions | | |
|---|---|---|---|
| | Hi-Temp I | Hi-Temp II | Example I |
| Magnesium | 7.3 | 29.9 | 25 |
| Strontium Nitrate | — | 51.9 | 35 |
| Strontium Peroxide | 70.9 | — | — |
| Calcium Resinate | 8.2 | 8.2 | — |
| Gelatin | 10.0 | 10.0 | — |
| Plasticized PVC | — | — | 20 |
| Carbon | 3.6 | — | — |
| Ammonium Perchlorate | — | — | 20 |
| Specific Impulse (sec.) | 464 | No Combustion | 700 |

As will be apparent to persons skilled in the art, various modifications, adaptations and variations of the foregoing specific disclosure can be made without departing from the teachings of the present invention.

We claim:

1. A fumer comprising a projectile having a base cavity therein and a pyrotechnic charge positioned within said cavity, said charge comprising about 30–55 percent by weight of an alkaline earth metal compound, about 20–35 percent by weight of a powdered metal fuel, about 20–50 percent by weight of a plasticized resin and about 10–30 percent by weight of an active oxidizer for said resin, said metal powder being present in greater than stoichiometric amounts relative to the amount of alkaline earth metal compound, said pyrotechnic composition being effective to provide rapid burning in the near wake area of the projectile resulting in a high specific impulse and fuel-rich combustion products.

2. The fumer of claim 1 wherein the ratio of metal powder to alkaline earth metal compound is at least about 2:3.

3. The fumer of claim 1 wherein the metal powder is magnesium powder and the alkaline earth metal compound is a nitrate selected from the group consisting of strontium nitrate and barium nitrate.

4. The fumer of claim 1 wherein the plasticized resin is a plasticized polymeric resin having a moderate to high chlorine content and the oxidizer for the resin is an inorganic perchlorate.

5. The fumer of claim 4 wherein the plasticized resin is free of volatile components and comprised of substantially equal proportions of a plasticizer and polyvinyl chloride resin.

6. The fumer of claim 1 wherein the metal powder is magnesium powder present as 25 percent by weight of the pyrotechnic charge and the alkaline earth metal compound is strontium nitrate present as 35 percent by weight of the pyrotechnic charge.

7. The fumer of claim 1 wherein the pyrotechnic charge consists essentially of 25 percent by weight of magnesium powder, 35 percent by weight of strontium nitrate, 10 percent by weight of polyvinyl chloride resin, 10 percent by weight of a plasticizer for the resin and 20 percent by weight of ammonium perchlorate.

8. The fumer of claim 1 including a first fire mix positioned within said cavity at said base to ignite said pyrotechnic charge.

9. A method of reducing the base drag of a projectile comprising the steps of providing a projectile having a base cavity therein and loading said cavity with a pyrotechnic charge that provides rapid burning in the near wake area of the projectile to effect a high specific impulse and fuel-rich combustion products, said pyrotechnic charge comprising about 30–55 percent by weight of an alkaline earth metal compound, about 20–35 percent by weight of a powdered metal fuel, about 20–50 percent by weight of a plasticized resin and about 10–30 percent by weight of an active oxidizer for said resin, said metal powder being present in greater than stoichiometric amounts relative to the amount of alkaline earth metal compound.

10. The method of claim 9 wherein the ratio of metal powder to alkaline earth metal compound is at least about 2:3.

11. The method of claim 9 wherein the metal powder is magnesium powder and the alkaline earth metal compound is a nitrate selected from the group consisting of strontium nitrate and barium nitrate.

12. The method of claim 9 wherein the plasticized resin is a plasticized polymeric resin having a moderate to high chlorine content and the oxidizer for the resin is an inorganic perchlorate.

13. The method of claim 9 wherein the plasticized resin is free of volatile components and comprised of substantially equal proportions of a plasticizer and polyvinyl chloride resin.

14. The method of claim 9 wherein the metal powder is magnesium powder present as 25 percent by weight of the pyrotechnic charge and the alkaline earth metal compound is strontium nitrate present as 35 percent by weight of the pyrotechnic charge.

15. The method of claim 9 wherein the pyrotechnic charge consists essentially of 25 percent by weight of magnesium powder, 35 percent by weight of strontium nitrate, 10 percent by weight of polyvinyl chloride resin, 10 percent by weight of a plasticizer for the resin and 20 percent by weight of ammonium perchlorate.

16. The method of claim 9 including a first fire mix positioned within said cavity at said base to ignite said pyrotechnic charge.

* * * * *